US011152710B2

(12) United States Patent
Butherus et al.

(10) Patent No.: US 11,152,710 B2
(45) Date of Patent: Oct. 19, 2021

(54) WIDE-BAND CONFORMAL COAXIAL ANTENNA

(71) Applicant: The Boeing Company, Chicago, IL (US)

(72) Inventors: Das D. Butherus, St. Charles, MO (US); Nicholas B. Mentesana, St. Louis, MO (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 16/677,558

(22) Filed: Nov. 7, 2019

(65) Prior Publication Data

US 2021/0143554 A1 May 13, 2021

(51) Int. Cl.

| | |
|---|---|
| ***H01Q 13/20*** | (2006.01) |
| ***H01Q 13/12*** | (2006.01) |
| ***H01Q 1/36*** | (2006.01) |
| ***H01Q 13/18*** | (2006.01) |

(52) U.S. Cl.

CPC ..... *H01Q 13/203* (2013.01); *H01Q 1/36* (2013.01); *H01Q 13/12* (2013.01); *H01Q 13/18* (2013.01)

(58) Field of Classification Search

CPC ..... H01Q 9/28; H01Q 13/203; H01Q 1/285; H01Q 5/47; H01Q 9/22; H01Q 9/30

See application file for complete search history.

(56) References Cited

U.S. PATENT DOCUMENTS 2,852,753 A * 9/1958 Lawrence ..... H01P 5/08 333/34
3,176,250 A * 3/1965 Marchand ..... H01P 1/225 333/34
5,369,367 A * 11/1994 Eisenhart ..... G01R 31/2822 324/632
5,557,290 A * 9/1996 Watanabe ..... H01Q 1/1285 343/713
5,995,059 A * 11/1999 Shoemaker ..... H01Q 1/42 343/790

(Continued)

OTHER PUBLICATIONS

Kraus, "Antennas," Second Edition, Tata McGraw-Hill Publishing Company Limited, 1988, pp. 1-460.

*Primary Examiner* — Vibol Tan
(74) *Attorney, Agent, or Firm* — Haynes and Boone, LLP

(57) ABSTRACT

Disclosed is a wide-band conformal coaxial antenna conformal to a surface that comprises an inner conductor, an outer conductor, and a dielectric layer. The inner conductor extends towards the surface from a coaxial input below the surface and the outer conductor surrounds the inner conductor extending from the coaxial input to the surface. The dielectric layer is between the inner conductor and the outer conductor. The inner conductor has a first inner conductor diameter at the coaxial input and a second inner conductor diameter at a distal end of the inner conductor at or proximately below the surface. The inner conductor forms an inner conductor surface at the distal end of the inner conductor and the second inner conductor diameter is larger than the first inner conductor diameter. The outer conductor has a first outer conductor diameter at the coaxial input and a second outer conductor diameter at the surface. The second outer conductor diameter is larger than the first outer conductor diameter.

20 Claims, 15 Drawing Sheets

(56) References Cited

U.S. PATENT DOCUMENTS

| | | | | |
|---|---|---|---|---|
| 6,081,170 | A * | 6/2000 | Enokuma | H01Q 5/47 333/134 |
| 6,356,241 | B1 * | 3/2002 | Jaeger | H01Q 13/0275 343/776 |
| 6,538,615 | B1 * | 3/2003 | Schantz | H01Q 9/005 343/773 |
| 9,325,074 | B2 * | 4/2016 | Chandler | H01Q 23/00 |

* cited by examiner

WIDE-BAND CONFORMAL COAXIAL ANTENNA

BACKGROUND

1. Technical Field

The present disclosure is related to antenna systems, and more particularly, for conformal antenna systems.

2. Prior Art

Space limitation and size requirements are constantly pushing antenna designs to smaller designs. Moreover, modern conformal antennas need to have low profiles to prevent drag while being rugged enough to withstand a harsh temperature and velocity environment while still providing the desired radiation patterns.

At present, existing non-conformal solutions are generally "whip" or "blade" type antennas and conformal solutions typically include cavity backed annular type slots, which are inherently gain and/or bandwidth limited. Many of these types of antennas require an impedance tuning mechanism such as, for example, a tuning cavity below the antenna or other reactive impedance elements. Moreover, known conformal antennas are directional type antennas that produce pencil like beams in their radiation patterns and are not capable of producing broad omnidirectional coverage in their radiation patterns such as, for example, isotropic monopole type radiation patterns. Unfortunately, as modern communication infrastructures grow, there is a need for antennas with omnidirectional coverage and wide bandwidths to ensure good communications and data sharing capabilities. Moreover, for aircraft, there is also a need to have these types of omnidirectional coverage and wide bandwidth antennas configured in a package that is clean and conformal to reduce drag and increase aerodynamic performance of the aircraft.

SUMMARY

Disclosed is a wide-band conformal coaxial antenna (WCCA) conformal to a surface. The WCCA comprises an inner conductor, an outer conductor, and a dielectric layer. The inner conductor extends towards the surface from a coaxial input below the surface and the outer conductor surrounds the inner conductor and extends from the coaxial input to the surface. The dielectric layer is between the inner conductor and the outer conductor. The inner conductor has a first inner conductor diameter at the coaxial input and a second inner conductor diameter at a distal end of the inner conductor at or proximately below the surface. The inner conductor forms an inner conductor surface at a distal end of the inner conductor. The second inner conductor diameter is larger than the first inner conductor diameter. The outer conductor has a first outer conductor diameter at the coaxial input and a second outer conductor diameter at the surface. The second outer conductor diameter is larger than the first outer conductor diameter.

Other devices, apparatuses, systems, methods, features, and advantages of the invention will be or will become apparent to one with skill in the art upon examination of the following figures and detailed description. It is intended that all such additional devices, apparatuses, systems, methods, features, and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

A wide-band conformal coaxial antenna (WCCA) conformal to a surface is disclosed. The WCCA comprises an inner conductor, an outer conductor, and a dielectric layer. The inner conductor extends towards the surface from a coaxial input below the surface and the outer conductor surrounds the inner conductor and extends from the coaxial input to the surface. The dielectric layer is between the inner conductor and the outer conductor. The inner conductor has a first inner conductor diameter at the coaxial input and a second inner conductor diameter at a distal end of the inner conductor at or proximately below the surface. The inner conductor forms an inner conductor surface at the distal end of the inner conductor. The second inner conductor diameter is larger than the first inner conductor diameter. The outer conductor has a first outer conductor diameter at the coaxial input and a second outer conductor diameter at the surface. The second outer conductor diameter is larger than the first outer conductor diameter.

The disclosed WCCA is an antenna system that is: conformal; wide-band; high-gain; configured to produce an isotropic pattern; high-power handling; and has impedance transforming capability without the need of a matching network or impedance transformer. Generally, the WCCA is a wide-band conformal antenna that creates an isotropic monopole type of radiation pattern and does not require a cavity or other type of impedance tuning mechanism (such as, for example, an impedance transformer or matching network). As a result of not having reactive impedance elements for a tuning mechanism, the WCCA has a high-power handling capability.

Figures 1A, 1B:
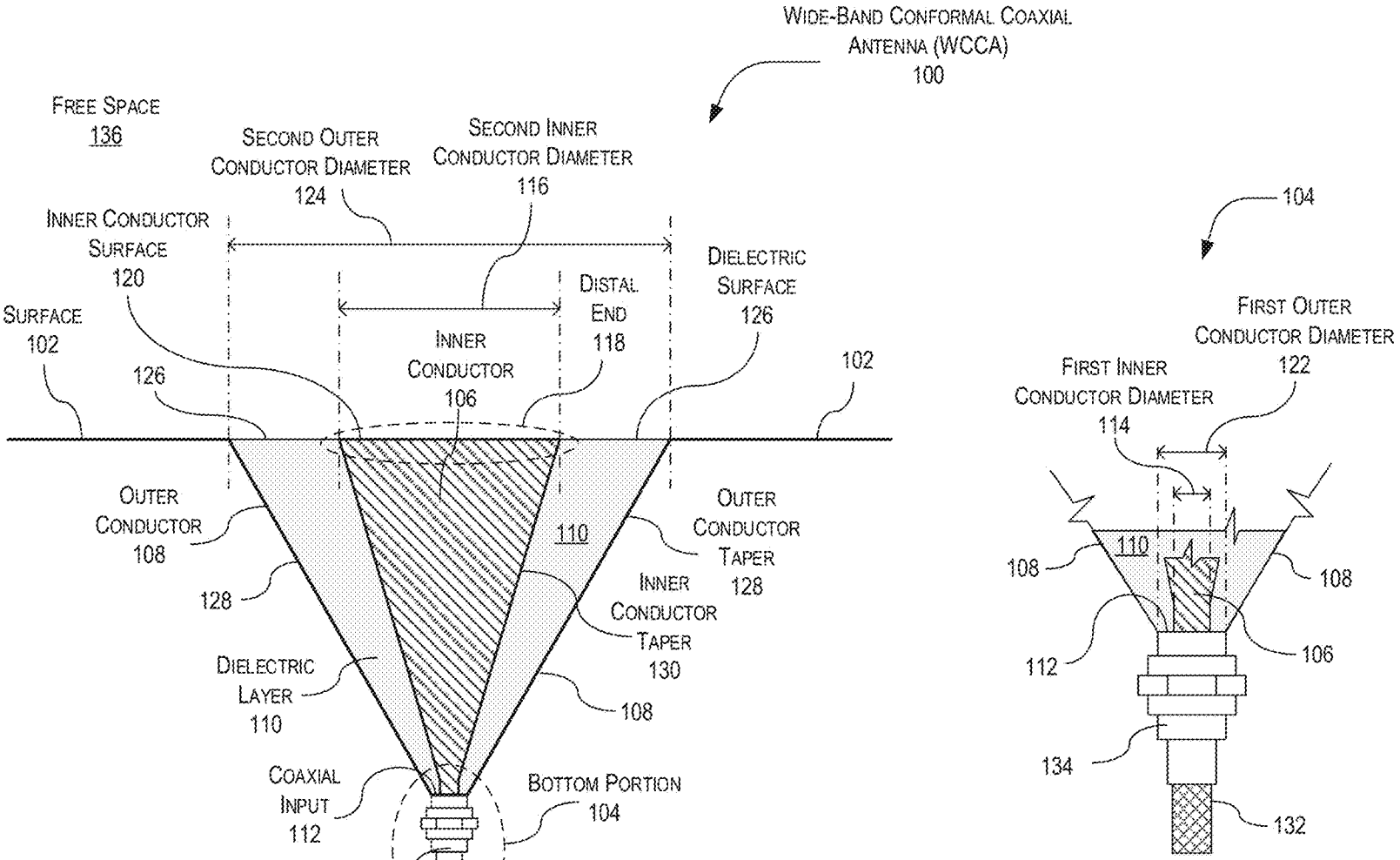
FIG. 1A is a side view of an example of an implementation of a wide-band conformal coaxial antenna (WCCA) in accordance with the present disclosure.
FIG. 1B is an amplified view of a bottom portion of the WCCA, shown in FIG. 1A, in accordance with the present disclosure.

In FIG. 1A, a side view of an example of an implementation of a WCCA 100 conformal to a surface 102 is shown in accordance with the present disclosure. FIG. 1B is an amplified view of a bottom portion 104 of the WCCA 100 in accordance with the present disclosure. The WCCA 100 comprises an inner conductor 106, an outer conductor 108, and a dielectric layer 110. In this example, the inner conductor 106 extends towards the surface 102 from a coaxial input 112 below the surface 102 and the outer conductor 108 surrounds the inner conductor 106 and extends from the coaxial input 112 to the surface 102. The dielectric layer 110 is between the inner conductor 106 and the outer conductor 108. The inner conductor 106 has a first inner conductor diameter 114 at the coaxial input 112 and a second inner conductor diameter 116 at a distal end 118 of the inner conductor 106 at or proximately below the surface 102. The inner conductor 106 forms an inner conductor surface 120 at the distal end 118 of the inner conductor 106 and the second inner conductor diameter 116 is larger than the first inner conductor diameter 114. The outer conductor 108 has a first outer conductor diameter 122 at the coaxial input 112 and a second outer conductor diameter 124 at the surface 102. The second outer conductor diameter 124 is larger than the first outer conductor diameter 122. In this example, the surface 102 is a conductive surface capable of acting as a ground plane such as, for example a metal.

In this example, the dielectric layer 110 extends from the coaxial input 112 to the surface 102 and includes a dielectric surface 126 that is approximately flush with the surface 102. Moreover, in this example, the inner conductor surface 120 is approximately flush with the dielectric surface 126. In other examples, the inner conductor surface 120 may be below the dielectric surface 126 by approximately half a wavelength of operation. The surface 102 is electrically connected to the outer conductor 108 and the surface 102 may be configured as a ground plane. Additionally, the combination of the surface 102, inner conductor surface 120, and dielectric surface 126 forms a slot antenna such as, for example, an annular slot antenna.

In this example the dielectric layer 110 surrounds the inner conductor 106 and separates it from the outer conductor 108. The dielectric layer 110 may be a lossy tuning material that is predetermined by the design of the WCCA 100. For example, the dielectric layer 110 may be a cyanide ester material having a permittivity of approximately 2.85 with a loss tangent of approximately 0.7. Other dielectric materials with lower loss tangents may also be utilized as well as dielectric materials that are compatible with additive manufacturing. Moreover, the dielectric layer 110 may include a plurality of different dielectric materials. As an example, the permittivity of the dielectric layer 110 may be approximately 2.2. Furthermore, as will be discussed later, the dielectric surface 126 may include a resistive element (not shown) that may be deposited on top of the dielectric surface 126 and the inner conductor surface 120. The resistive element may comprise a plurality of resistive sub-elements such as, for example, spiral resistive elements.

The outer conductor 108 may have an outer conductor taper 128 that is configured to taper between the first outer conductor diameter 122 and the second outer conductor diameter 124. As an example, the outer conductor taper 128 may be conical, exponential, or any other taper based on the design of the WCCA 100. Additionally, the inner conductor 106 may have an inner conductor taper 130 that is configured to taper between the first inner conductor diameter 114 and the second inner conductor diameter 116. Also, as an example, the inner conductor taper 130 may be conical, exponential, or any other taper based on the design of the WCCA 100.

In the case of a conical taper, the outer conductor 108 may have a radius (i.e., half of the outer conductor diameter) that may vary linearly between the coaxial input 112 and the surface 102.

In the case of an exponential taper, the exponential taper may be determined utilizing techniques related to tapered transmission lines for matching a source to a load where the characteristic impedance of a tapered transmission lines varies exponentially along its length. In this example, the WCCA 100 acts as a matching tapered transmission line having a length that is equal to the depth 140 and has the outer conductor taper 128 that varies from the first outer conductor diameter 122 to the second outer conductor diameter 124 with an exponential taper that may be proportional to a varying radius of the outer conductor 108. In this example, the outer conductor taper 128 may be a simple exponential taper where the characteristic impedance Z(x) of the WCCA 100 varies smoothly, as a function of distance x (i.e., depth 140), from the impedance $Z_0$ of the coaxial cable 132 at the coaxial input 112 (where x=0) to the impedance $Z_L$ at the surface 102 (i.e., the load that is free space) where x is equal to the depth 140. As such, the depth 140 is the length of an impedance transformer formed by the WCCA 100 that transforms the characteristic impedance Z(x) of the WCCA 100 from the input impedance $Z_0$ at the coaxial input 112 to the output impedance of free space $Z_L$ at the surface 102. As an example, the impedance of the WCCA 100 may vary based on the radius (i.e., half the diameter) of the outer conductor 108. In general, the radius of the outer conductor 108 that may vary based on $ae^{\omega x}$, where a is a slope design variable of the taper, ω is a frequency in radians, and x is the varying length of the depth 140.

Similar to the outer conductor taper 128, the inner conductor taper 130 also has a radius (i.e., half of the inner conductor diameter) that may vary linearly between the coaxial input 112 and the inner conductor surface 120 for a conical taper or vary based on $ae^{\omega x}$, for an exponential taper, where a is the slope design variable of the taper, ω is the frequency in radians, and x is the varying length of the depth 140.

The WCCA 100 is electrically connected to a coaxial cable 132 via a coaxial connector 134 at the coaxial input 112. In general, the WCCA 100 is an impedance transformer between the coaxial cable 132 (e.g., 50 ohms or 75 ohms) and free space (about 377 ohms) at the combination of the dielectric surface 126 and inner conductor surface 120. In this example, the inner conductor 106 is electrically connected to the inner conductor (not shown) of the coaxial cable 132 through the coaxial connector 134. Similarly, the outer conductor 108 is electrically connected to the outer conductor of the coaxial cable 132 through the coaxial connector 134.

Figure 1C:
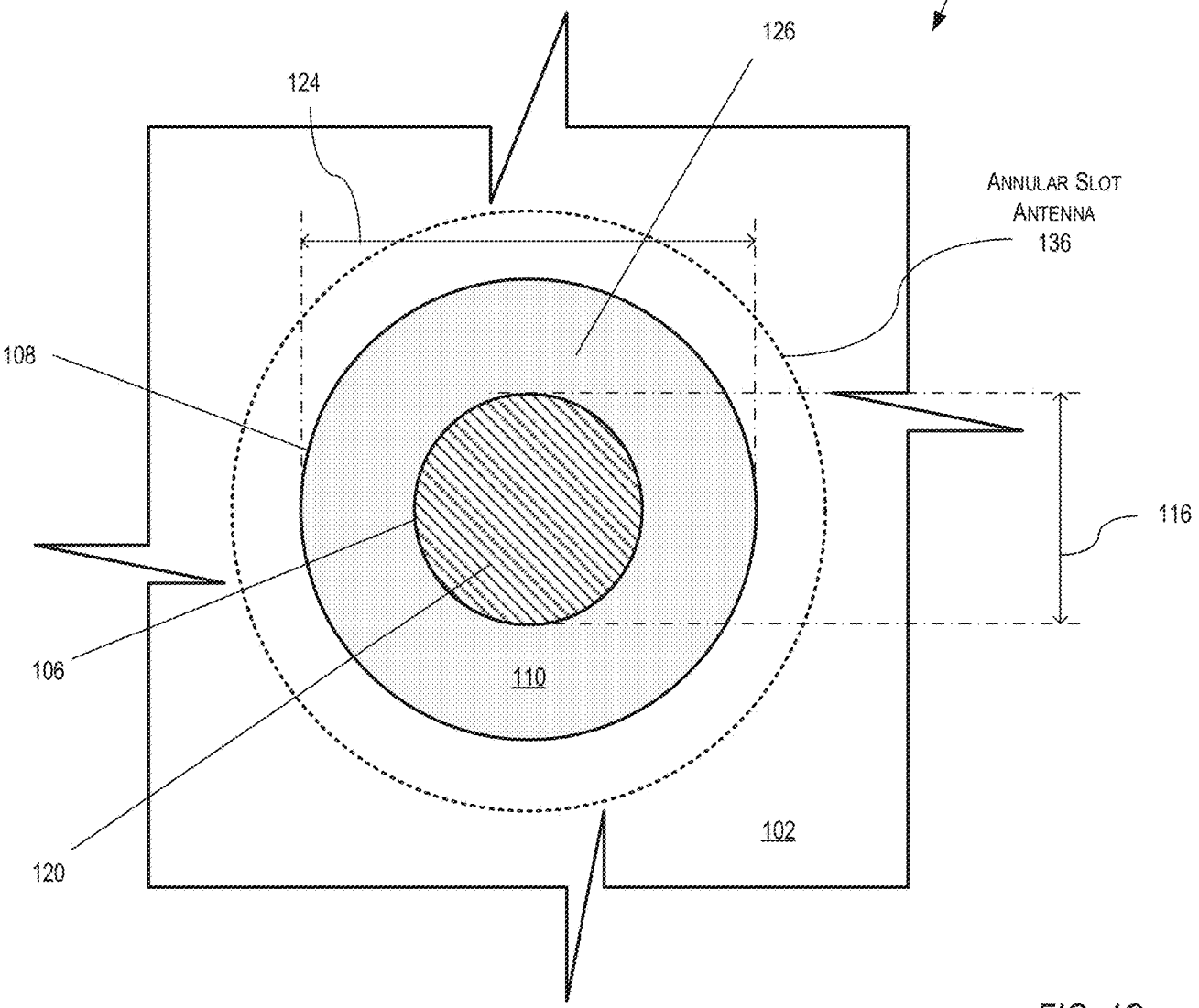
FIG. 1C is a top view of an example of an implementation of the WCCA, shown in FIGS. 1A and 1B, in accordance with the present disclosure.

In FIG. 1C, a top view of the WCCA 100 is shown in accordance with the present disclosure. In this example, the inner conductor surface 120 is approximately flush with the dielectric surface 126 and surface 102 forming an annular slot antenna 136, where the surface 102 acts as a ground plane for the annular slot antenna 136.

Figure 1D:
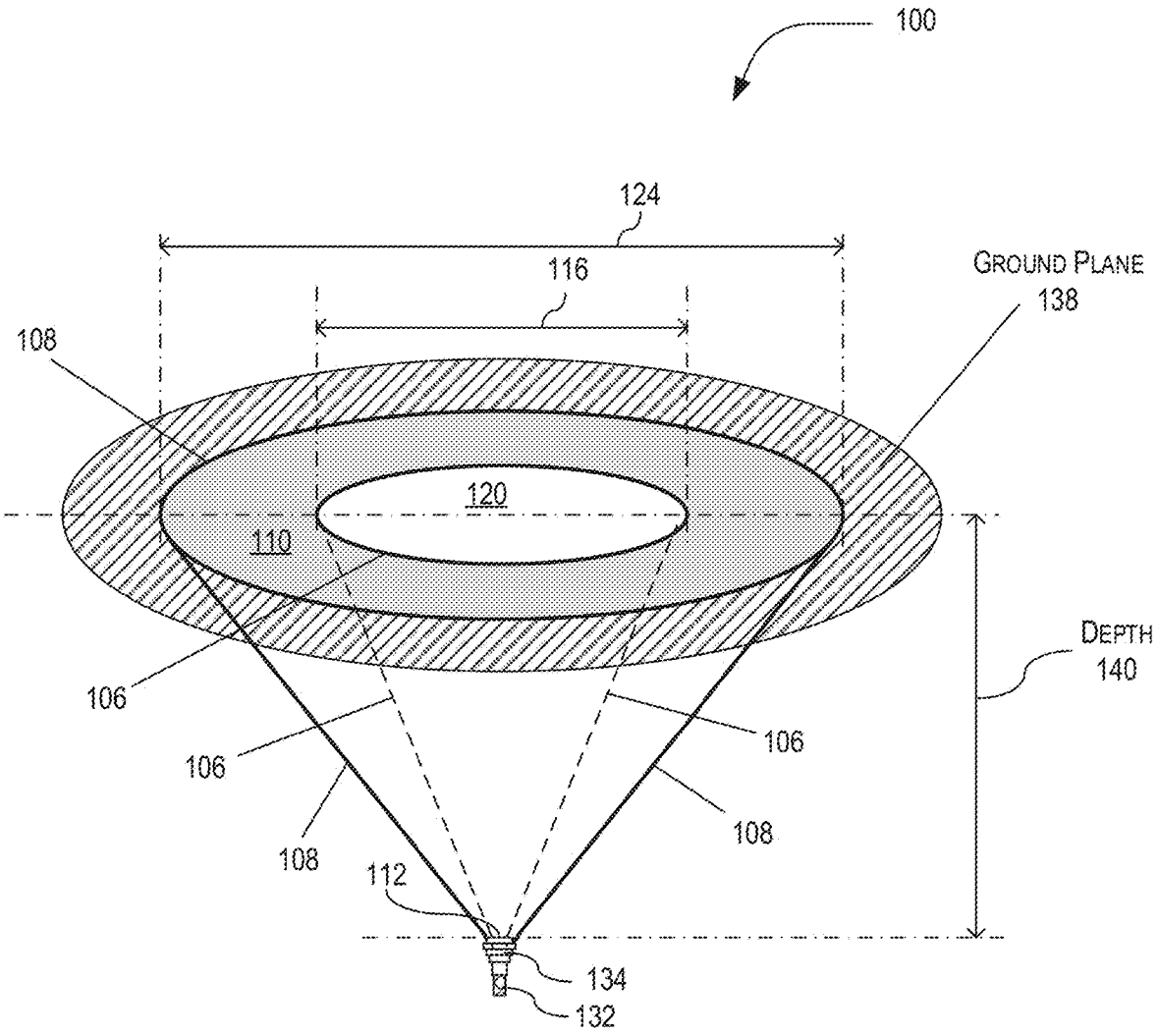
FIG. 1D is a perspective top view of the WCCA, shown in FIGS. 1A, 1B, and 1C, in accordance with the present disclosure.

In FIG. 1D, a perspective top view of the WCCA 100 is shown in accordance with the present disclosure. In this example, a portion of the surface 102 is shown as a ground plane 138 next to the WCCA 100. As an example of an implementation, the WCCA 100 may have a depth 140 of approximately 2 inches below the surface 102 to the coaxial input 112. The second inner conductor diameter 116 may be approximately two inches and the second outer conductor diameter 124 may be approximately four inches. In general, the second inner conductor diameter 116 may be at least one wavelength of the frequency of operation and the depth 140 may be approximately one-half wavelength of the frequency of operation.

Figure 2A:
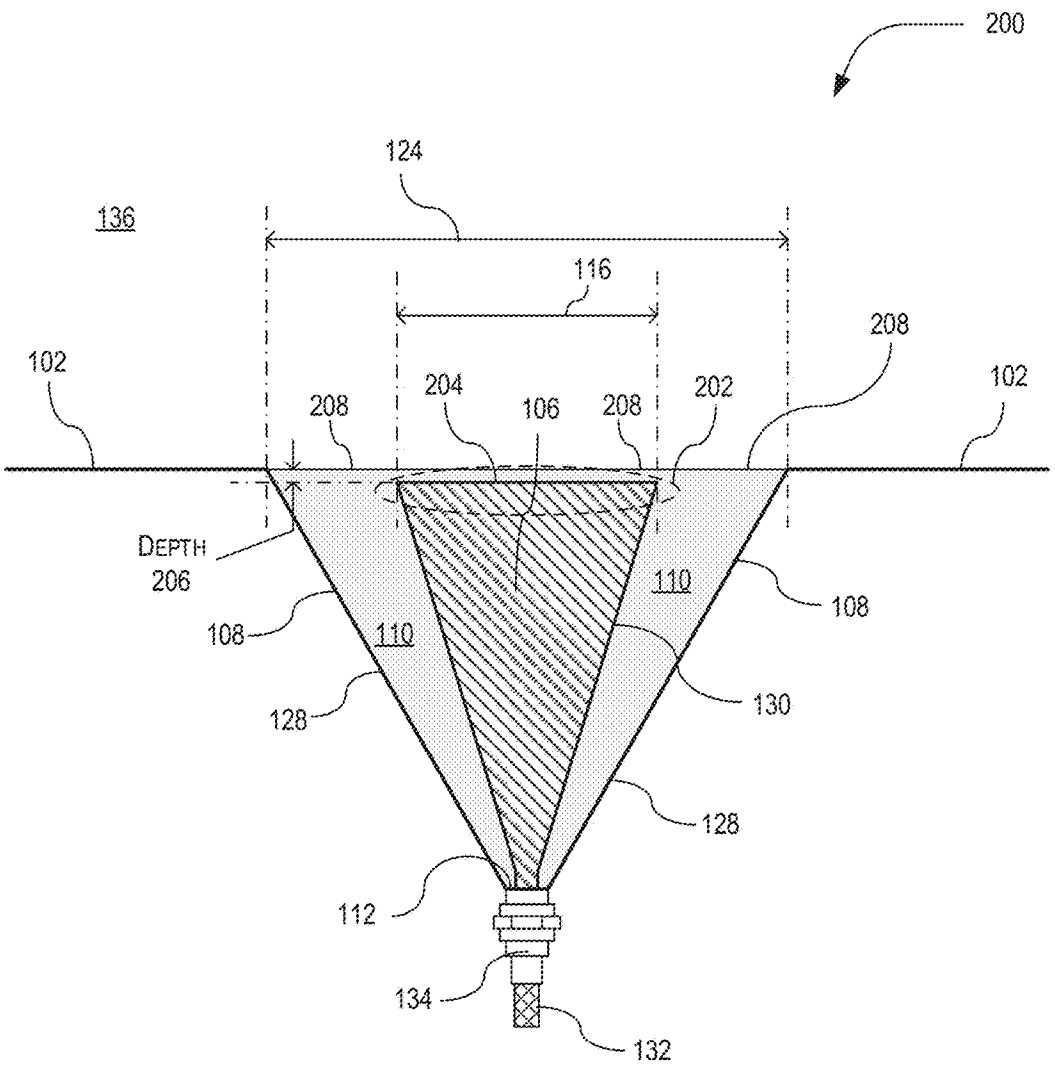
FIG. 2A is a side view of an example of another implementation of a WCCA in accordance with the present disclosure.

Turning to FIG. 2A, a side view of an example of another implementation of a WCCA 200 conformal to the surface 102 is shown in accordance with the present disclosure. In this example, a distal end 202 and an inner conductor surface 204 are below the surface 102 at a depth 206 below the surface 102. The dielectric layer 110 fills the depth 206 such that the dielectric surface 208 is flush with the surface 102 above the inner conductor surface 204.

Figure 2B:
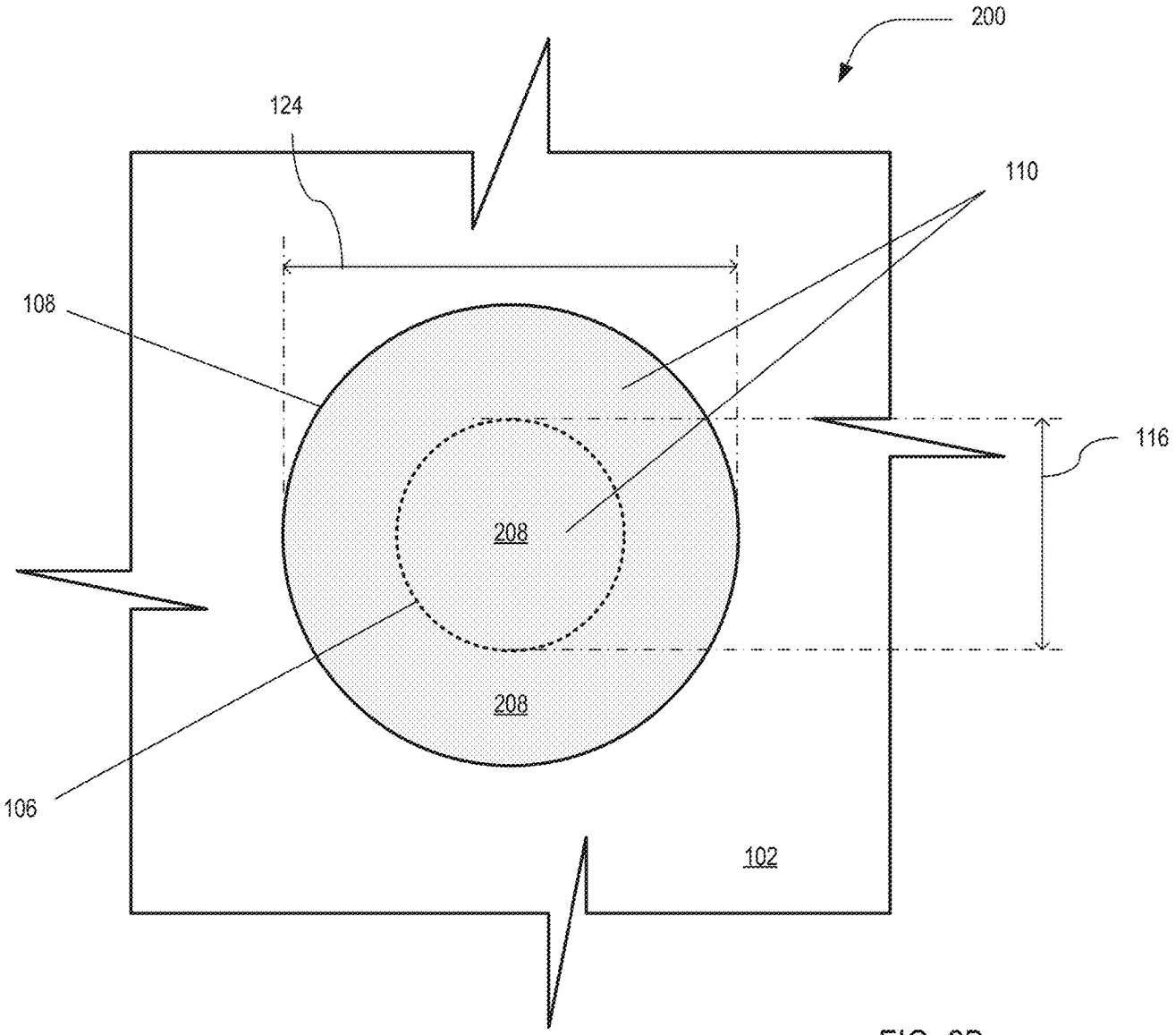
FIG. 2B is a top view of the WCCA, shown in FIG. 2A, in accordance with the present disclosure.

In FIG. 2B, a top view of the WCCA 200 is shown in accordance with the present disclosure. In this example, the inner conductor surface 204 is below the dielectric surface 208 and the surface 102 and is covered by part of the dielectric layer 110 such that only the dielectric surface 208 is flush with the surface 102.

Figure 3:
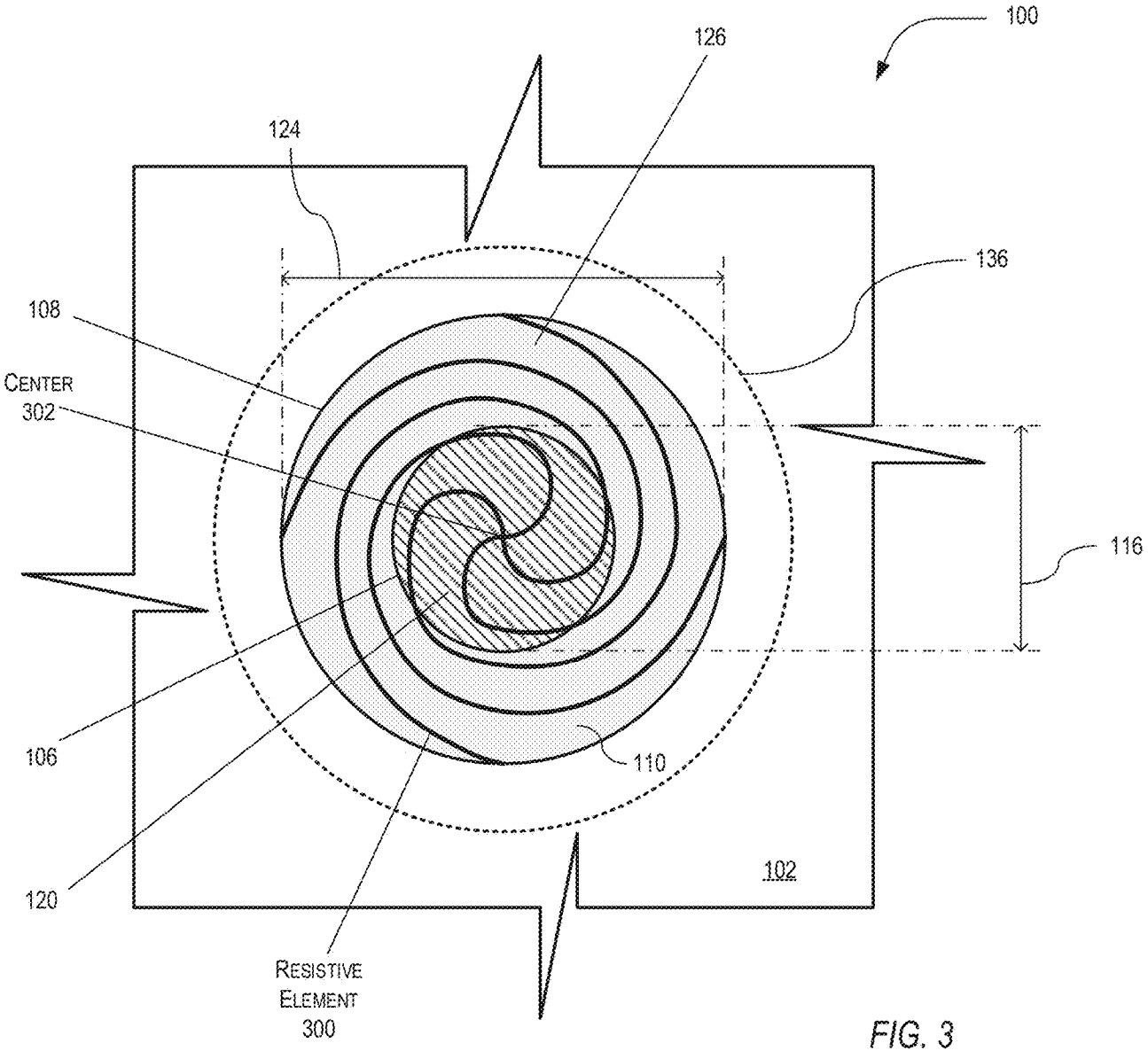
FIG. 3 is a top view of the WCCA, shown in FIGS. 1A through 1D, with a resistive element in accordance with the present disclosure.

In FIG. 3, a top view of the WCCA 100 (of FIGS. 1A-1D) is shown with a resistive element 300 in accordance with the present disclosure. In this example, the resistive element 300 is shown having a plurality of resistive sub-elements that may be may, for example, a plurality of spiral resistive elements that start at a center 302 of the inner conductor surface 120 and extend outward over the inner conductor surface 120 and dielectric surface 126 to the outer conductor 108 and/or surface 102. In this example, the resistive element 300 acts a tuning element that tunes the electrical properties of the WCCA 100 to either better match the impedance of free space at the surface 102 or improve and/or modify the performance and/or radiation pattern of the annular slot antenna 136. Generally, in this example, the WCCA 100 is matched when the radius (i.e., half of the second outer conductor diameter 124) and depth 140 are at least half of a wavelength at the lowest operating frequency. The spiral elements of the resistive element 300 may be conductive spiral elements that operate as inductors to tune the WCCA 100 when the WCCA 100 needs to be smaller in size. In this example, the use of resistive sheets for the resistive element 300 over the dielectric surface 126 creates losses that reduce the broadband return loss for the WCCA 100 at the expense of efficiency. In general, this tuning process is specific to size, performance and frequency requirements of the WCCA 100.

Figure 4:
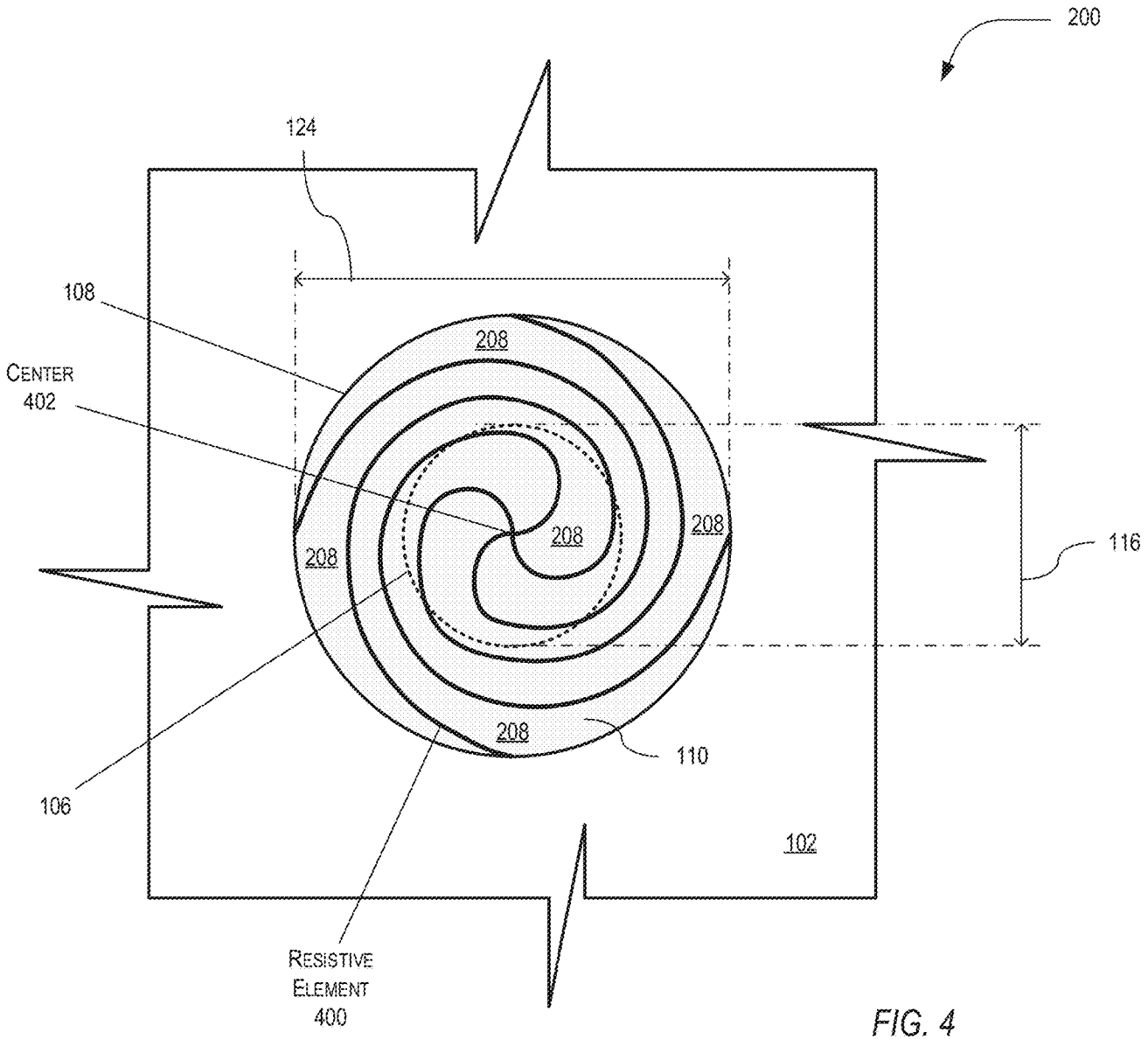
FIG. 4 is a top view of the WCCA, shown in FIGS. 2A and 2B, with a resistive element in accordance with the present disclosure.

In FIG. 4, a top view of the WCCA 200 (of FIGS. 2A and 2B) is shown with a resistive element 400 in accordance with the present disclosure. Similar to the example described in relation to FIG. 3, in this example, the resistive element 400 is also shown having a plurality of resistive sub-elements that may be may, for example, a plurality of spiral resistive elements that start at a center 402 of the dielectric surface 208 and extend outward over the dielectric surface 208 to the outer conductor 108 and/or surface 102. In this example, the resistive element 400 acts as a tuning element that tunes the electrical properties of the WCCA 200 to either better match the impedance of free space at the surface 102 or improve and/or modify the performance and/or radiation pattern of the WCCA 200.

In these examples, it is appreciated by those of ordinary skill in the art that the resistive elements 300 and 400 are generally utilized as inductive tuning and/or resistive elements when the configuration of the WCCA 100 or 200 is electrically small such as, for example, when the second outer conductor diameter 124 is less than a wavelength of operation or the depth 140 is less than half a wavelength of operation. In this example, the wavelength of operation may be the wavelength corresponding to either center frequency of operation or the lowest frequency of operation.

Figure 5B:
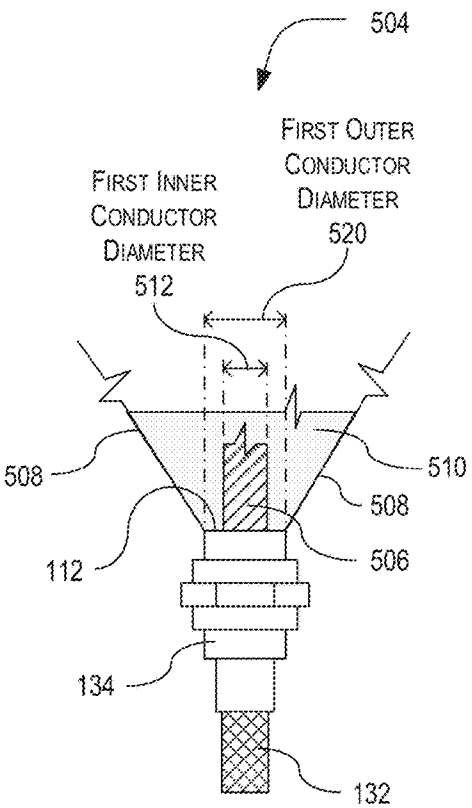
FIG. 5B is an amplified view of a bottom portion of the WCCA, shown in FIG. 5A, in accordance with the present disclosure.
Figure 5A:
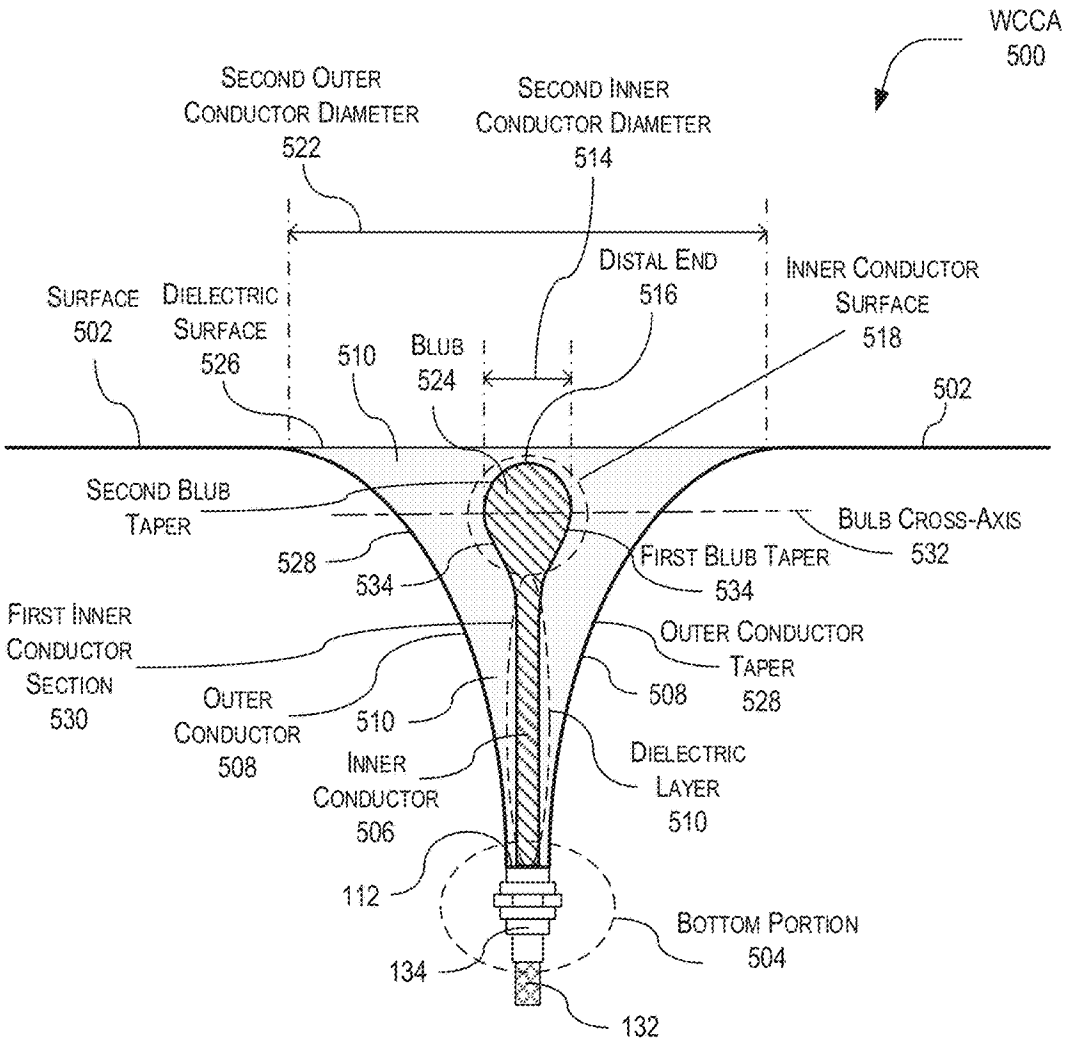
FIG. 5A is a side view of an example of another implementation of a WCCA conformal to a surface in accordance with the present disclosure.

Turning to FIG. 5A, a side view of an example of another implementation of a WCCA 500 conformal to a surface 502 is shown in accordance with the present disclosure. FIG. 5B is an amplified view of a bottom portion 504 of the WCCA 500 in accordance with the present disclosure. The WCCA 500 comprises an inner conductor 506, an outer conductor 508, and a dielectric layer 510. In this example, the inner conductor 506 extends towards the surface 502 from the coaxial input 112 below the surface 502 and the outer conductor 508 surrounds the inner conductor 506 and extends from the coaxial input 112 to the surface 502. The dielectric layer 510 is between the inner conductor 506 and the outer conductor 508. The inner conductor 506 has a first inner conductor diameter 512 at the coaxial input 112 and a second inner conductor diameter 514 at a distal end 516 of the inner conductor 506 at or proximately below the surface 502. The inner conductor 506 forms an inner conductor surface 518 at the distal end 516 of the inner conductor 506. The second inner conductor diameter 514 is larger than the first inner conductor diameter 512. The outer conductor 508 has a first outer conductor diameter 520 at the coaxial input 112 and a second outer conductor diameter 522 at the surface 502. The second outer conductor diameter 522 is larger than the first outer conductor diameter 520. In this example, the inner conductor surface 518 forms a bulb 524 at the distal end 516 of the inner conductor 506, where the inner conductor surface 518 is a surface of the bulb 524. Moreover, the surface 502 may be the same as the surface 102 described earlier and shown in FIGS. 1A-4, where the surface 502 is a conductive surface capable of acting as a ground plane such as, for example a metal. In this example, the distal end 516 may be, for example, 0.03 inches below the dielectric surface 526.

In this example, the dielectric layer 510 extends from the coaxial input 112 to the surface 502 and includes a dielectric surface 526 that is approximately flush with the surface 502. Moreover, in this example, the inner conductor surface 518 of the bulb 524, at the distal end 516 of the inner conductor 506, is below or approximately flush with the dielectric surface 526. The surface 502 is electrically connected to the outer conductor 508 and the surface 502 may be configured as a ground plane.

The outer conductor 508 may have an outer conductor taper 528 that is configured to taper between the first outer conductor diameter 520 and the second outer conductor diameter 522. As an example, the outer conductor taper 528 may be conical, exponential, or any other taper based on the design of the WCCA 500. In this example, the outer conductor taper 528 is exponential. Additionally, the inner conductor 506 may have an inner conductor taper along the inner conductor surface 518 of the bulb 524.

In this example, the inner conductor 506 includes the bulb 524 and a first inner conductor section 530 below the bulb 524. The first inner conductor section 530 may be a cylindrical type of conductor that extends from the coaxial input 112 to the bottom of the bulb 524. The bulb 524 includes a cross-sectional diameter below the distal end 516 of the inner conductor 506 at a bulb cross-axis 532, where the cross-sectional diameter of the bulb 524 corresponds to the second inner conductor diameter 514.

The surface of the bulb 524 begins at the first inner conductor section 530 below the bulb 524 and ends at the distal end 516 of the inner conductor 506. The surface (i.e., the inner conductor surface 518) of the bulb 524 has a first bulb taper 534 that is configured to taper between the first inner conductor section 530 and the bulb cross-axis 532. Moreover, the surface of the bulb 524 may also have a second bulb taper 536 that is configured to taper from the bulb cross-axis 532 to the distal end 516 of the inner conductor 506. As an example, the first bulb taper 534 and/or second bulb taper 536 may be exponential. In this example, the outer conductor taper 528, first bulb taper 534, and second bulb taper 536 may be designed as described earlier.

In this example the dielectric layer 510 surrounds the inner conductor 506 and separates it from the outer conductor 508. The dielectric layer 510 may be a lossy tuning material that is predetermined by the design of the WCCA 500. As discussed earlier, the dielectric layer 110 may be, for example, a cyanide ester material having a permittivity of approximately 2.85 with a loss tangent of approximately 0.7. Other dielectric materials with lower loss tangents may also be utilized as well as dielectric materials that are compatible with additive manufacturing. The dielectric layer 510 may comprise a plurality of different dielectric materials. Furthermore, as will be discussed later, the dielectric surface 526 may comprise a resistive element (not shown) that may be deposited on top of the dielectric surface 526. The resistive element may include a plurality of resistive sub-elements such as, for example, spiral resistive elements.

Figure 5C:
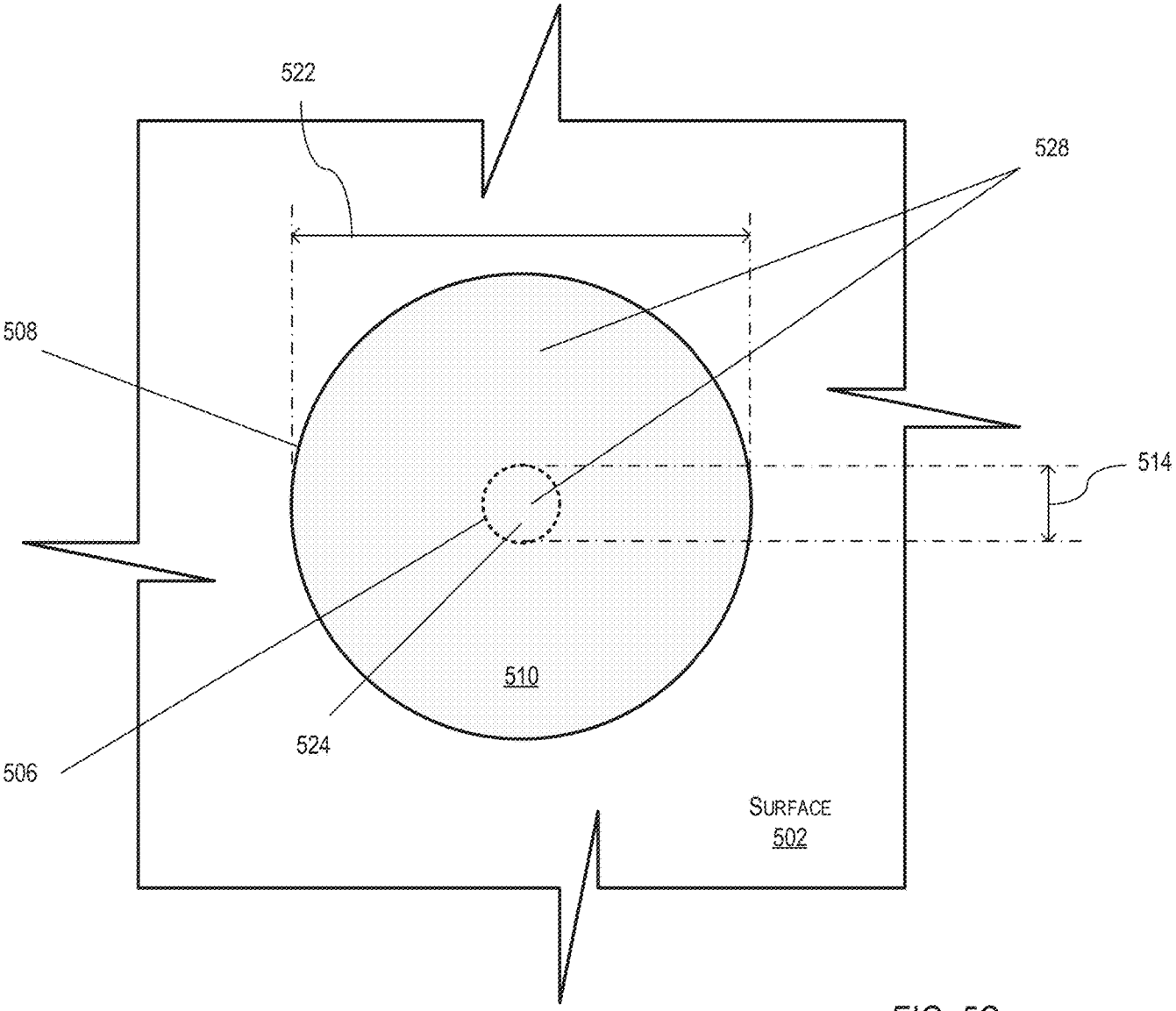
FIG. 5C is a top view of the WCCA, shown in FIGS. 5A and 5B, in accordance with the present disclosure.

In FIG. 5C, a top view of the WCCA 500 is shown in accordance with the present disclosure. In this example, the inner conductor surface 518 is below the dielectric surface 526 and the surface 502, where the surface 502 acts as a ground plane for the WCCA 500.

Figure 6:
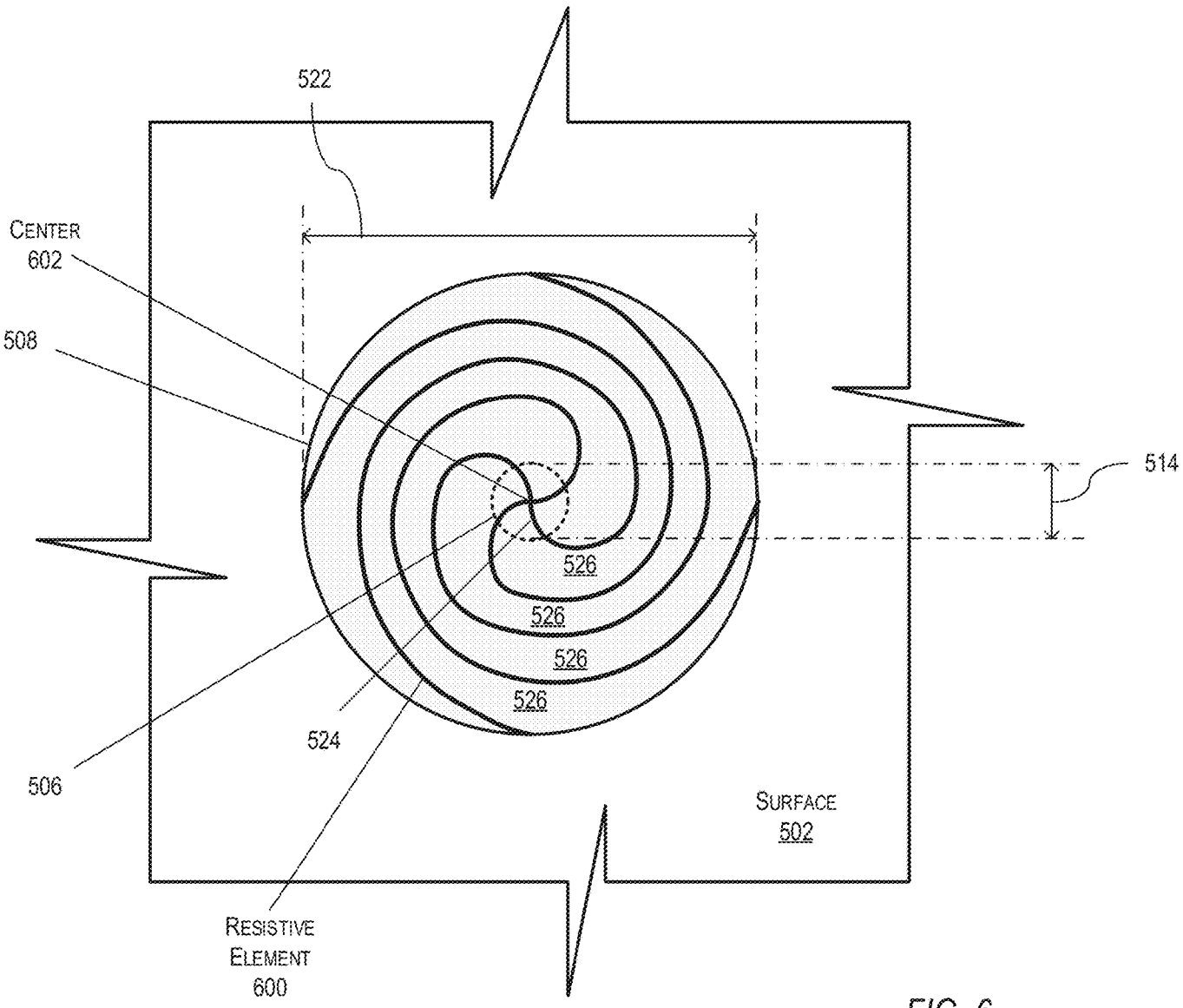
FIG. 6 is a top view of the WCCA, shown in FIGS. 5A through 5C, with a resistive element in accordance with the present disclosure.

In FIG. 6, a top view of the WCCA 500 (of FIGS. 5A-5C) is shown with a resistive element 600 in accordance with the present disclosure. In this example, the resistive element 600 is shown having a plurality of resistive sub-elements that may be, for example, a plurality of spiral resistive elements that start at a center 602 and extend outward over the dielectric surface 526 to the outer conductor 508 and/or surface 502. In this example, and as discussed earlier in relation to FIG. 3, the resistive element 600 acts as a tuning element that tunes the electrical properties of the WCCA 500 to either better match the impedance of free space at the surface 502 or improve and/or modify the performance and/or radiation pattern of the WCCA 500.

In this example, it is also appreciated by those of ordinary skill in the art that the resistive element 600 is generally utilized as inductive tuning and/or resistive elements when the configuration of the WCCA 500 is electrically small such as, for example, when the second outer conductor diameter 522 is less than a wavelength of operation or the depth (the distance between the coaxial input 112 and the surface 502) is less than half a wavelength of operation. In this example, the wavelength of operation may be the wavelength corresponding to either center frequency of operation or the lowest frequency of operation.

Figure 7:
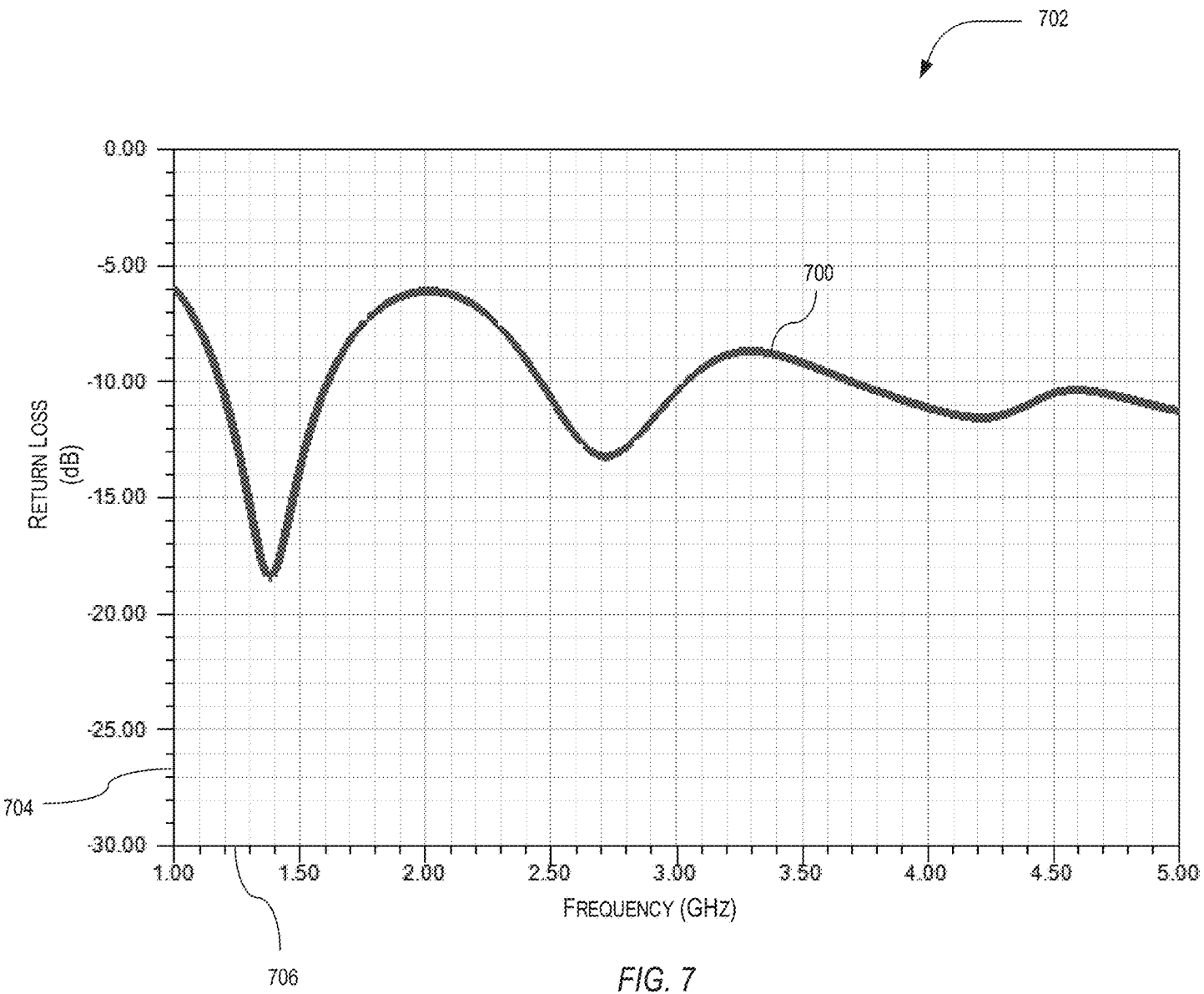
FIG. 7 is an example of a plot of the return loss for the WCCA, shown in FIGS. 1A through 1D, in accordance with the present disclosure.

In FIG. 7, an example of a plot 700 of the return loss for the WCCA 100 is shown in accordance with the present disclosure. In this example, the graph 702 has a vertical axis 704 that represents a return loss in decibels (dB) that ranges from −30 dB to 0 dB and a horizontal axis 706 that represents a frequency in Gigahertz (GHz) that ranges from 1.00 GHz to 5.00 GHz. The plot 700 shows that the return loss is less than −5 dB over a wide-band between the 1.00 GHz to 5.00 GHz. As discussed earlier, this means that very little energy is reflected back into the coaxial input 112 and the impedance of the coaxial cable 132 is approximately matched over a wide-band of frequencies even though the input impedance at the bottom of the WCCA 100 is matched to, for example, the 50 ohm impedance of the coaxial cable and the top of the WCCA 100 (at the surface 102) is matched to free space (approximately 377 ohms). As such, the WCCA 100 is a wide-band impendence transformer between the coaxial cable 132 and free space at the surface 102. As a result, the WCCA 100 is an antenna that does not need an input impedance transformer because the input to the WCCA 100 is impedance matched to the coaxial input 112 and the output of the WCCA 100 is matched to free space.

Figure 8:
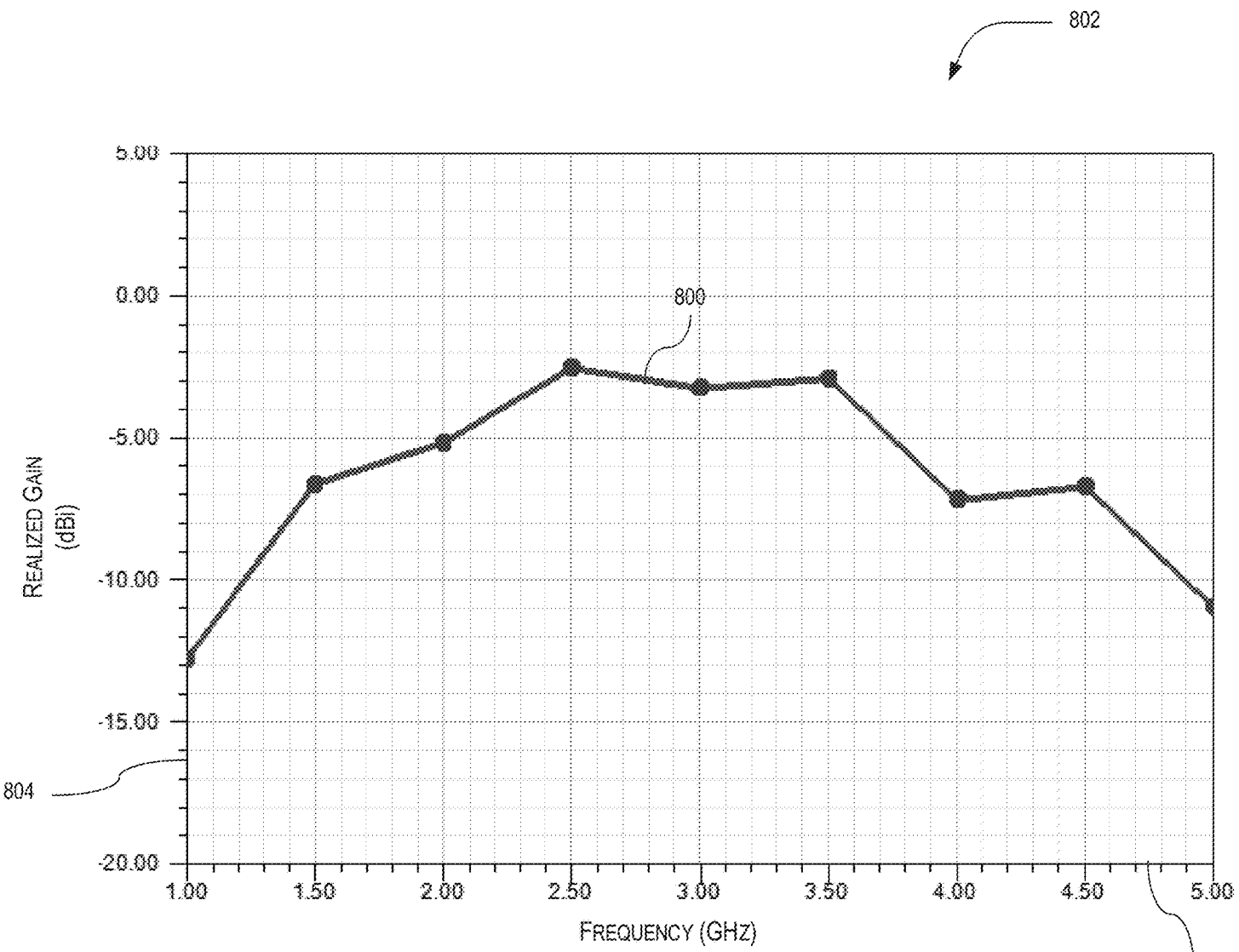
FIG. 8 is an example of a plot of the gain for the WCCA, shown in FIGS. 1A through 1D, in accordance with the present disclosure.

FIG. 8 is an example of a plot 800 of the gain for the WCCA 100 in accordance with the present disclosure. In this example, the graph 802 has a vertical axis 804 that represents a realized gain in decibels (dBi) that ranges from −20 dB to 5 dB and a horizontal axis 806 that represents a frequency in Gigahertz (GHz) that ranges from 1.00 GHz to 5.00 GHz. The plot 800 shows that the realized gain is greater than −13 dB over a wide-band between 1.00 GHz to 5.00 GHz.

Figure 9:
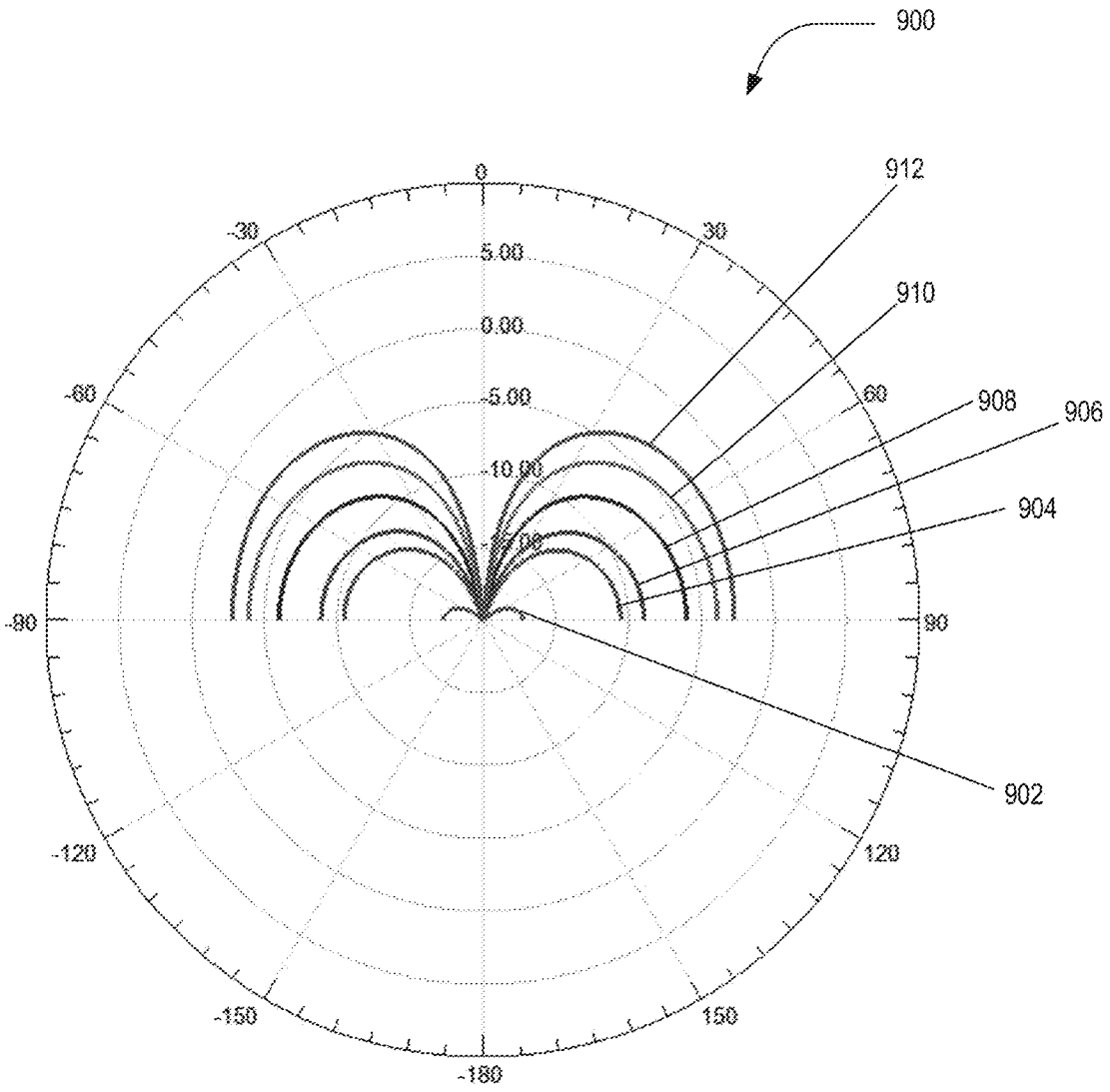
FIG. 9 is an example of a plurality of plots of the radiation pattern for the WCCA, shown in FIGS. 1A through 1D, in accordance with the present disclosure.

In FIG. 9, an example of a plurality of plots 900 of the radiation pattern for the WCCA 100 with the resistive element 300 are shown in accordance with the present disclosure. In this example, the plots 900 of the radiation pattern are shown to be isotropic for different frequencies of operation. As an example, a first plot 902 corresponds to a radiation pattern for the WCCA 100 that has a permittivity equal to 2.2, a resistive element 300 having an impedance value of approximately 400 ohms and a coil shunt, a depth 140 equal to 1.25 inches, a second outer conductor diameter 124 equal to 2.0 inches (i.e., the radius is equal to 1.0 inches), a first outer conductor diameter 122 equal to 0.9 inches (i.e., the radius is equal to 0.45 inches) at frequency of 1.0 GHz. The second plot 904 corresponds to a radiation pattern for the WCCA 100 with the same physical dimensions at a frequency of 1.6 GHz. The third plot 906 corresponds to a radiation pattern for the WCCA 100 with the same physical dimensions at a frequency of 2.0 GHz. The fourth plot 908 corresponds to a radiation pattern for the WCCA 100 with the same physical dimensions at a frequency of 3.0 GHz. The fifth plot 910 corresponds to a radiation pattern for the WCCA 100 with the same physical dimensions at a frequency of 4.0 GHz. The sixth plot 912 corresponds to a radiation pattern for the WCCA 100 with the same physical dimensions at a frequency of 5.0 GHz.

Figure 10:
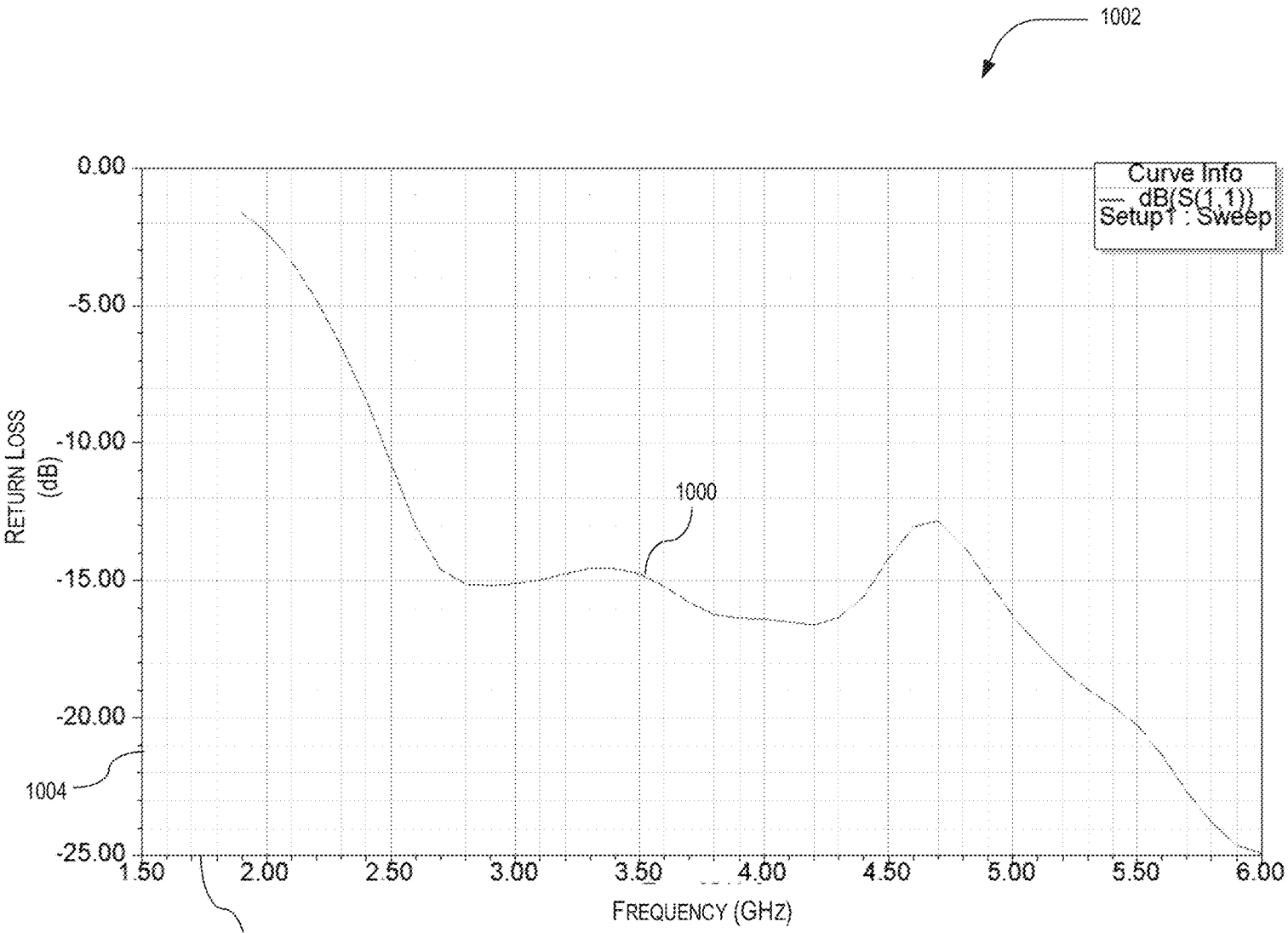
FIG. 10 is an example of a plot of the return loss for the WCCA, shown in FIGS. 5A through 5C, in accordance with the present disclosure.

Turning to FIG. 10, an example of a plot 1000 of the input impedance for the WCCA 500 is shown in accordance with the present disclosure. In this example, a graph 1002 of the plot 1000 has a vertical axis 1004 that represents a return loss in decibels (dB) that ranges from −25 dB to 0 dB and a horizontal axis 1006 that represents a frequency in Gigahertz (GHz) that ranges from 1.50 GHz to 6.00 GHz. The plot 1000 shows that the return loss drops to −5 dB at approximately 2.25 GHz and stays low over a wide-band up to 6 GHz. Again, this means that very little energy is reflected back into the coaxial input 112 and the impedance of the coaxial cable 132 is approximately matched over a wide-band of frequencies even though the input impedance at the bottom of the WCCA 500 is matched to, for example, the 50 ohm impedance of the coaxial cable and the top of the WCCA 500 (at the surface 502) is matched to free space (approximately 377 ohms). As such, the WCCA 500 is a wide-band impendence transformer between the coaxial cable 132 and free space at the surface 502. As a result, the WCCA 500 is also an antenna that does not need an input impedance transformer because the input is impedance matched to the coaxial input 112 and the output is matched to free space.

Figure 11:
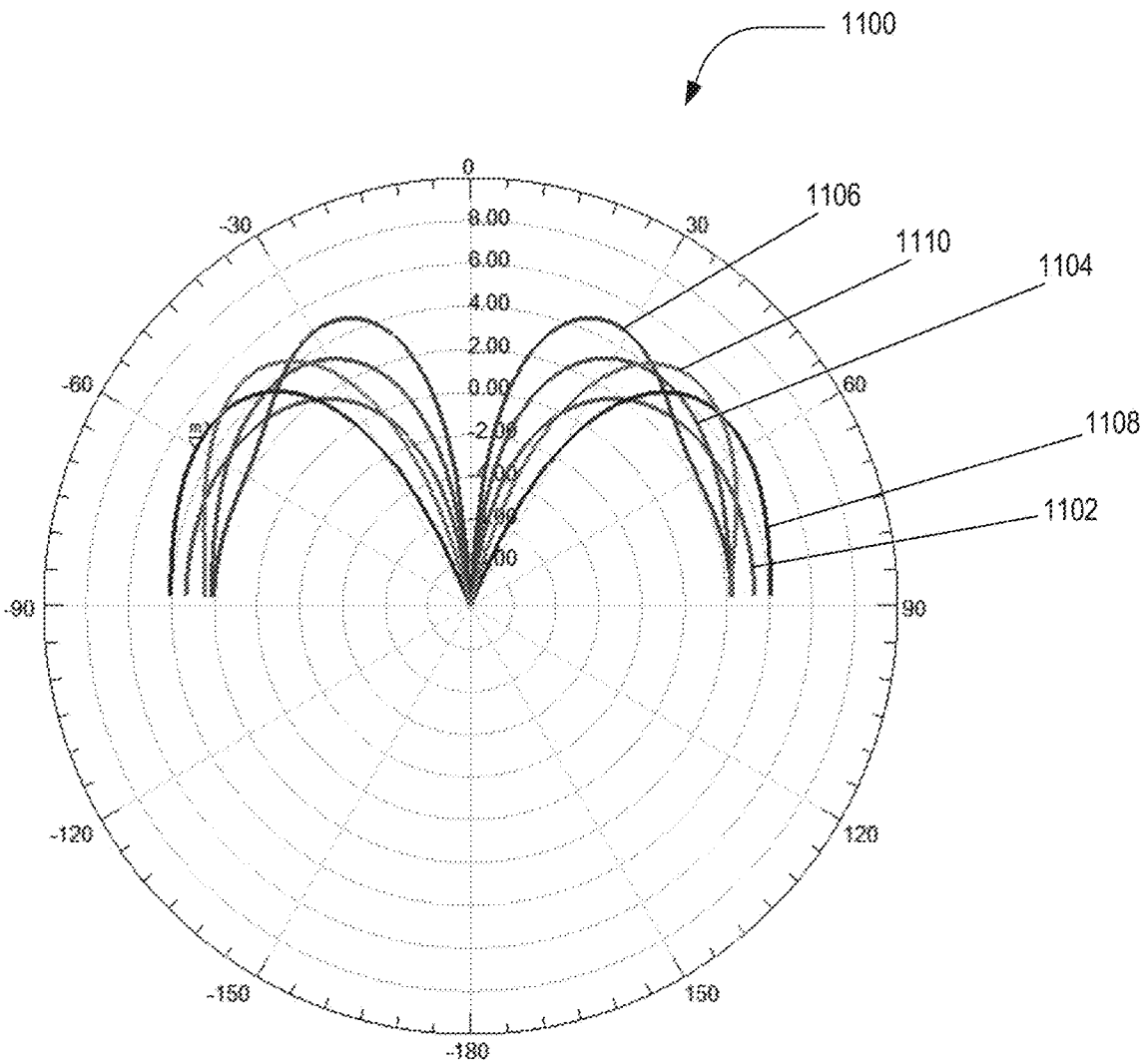
FIG. 11 is an example of a plurality of plots of the radiation pattern for the WCCA, shown in FIGS. 5A through 5C, in accordance with the present disclosure.

In FIG. 11, a graphical representation of an example of a graph 1100 of a plurality of plots 1102, 1104, 1106, 1108, and 1110 of the radiation patterns for the WCCA 500 at different frequencies is shown in accordance with the present disclosure. In this example, the plurality of plots 1102, 1104, 1106, 1108, and 1110 of the radiation patterns are shown to be isotropic for different frequencies of operation. As an example, a first plot 1102 corresponds to a radiation pattern for the WCCA 500 that has a permittivity equal to 2.2, a depth equal to 2.5 inches, a second outer conductor diameter 522 equal to 5.0 inches (i.e., the radius is equal to 2.5 inches), a first outer conductor diameter 520 equal to 0.8 inches (i.e., the radius is equal to 0.4 inches) at frequency of 2.5 GHz. The second plot 1104 corresponds to a radiation pattern for the WCCA 500 with the same physical dimensions at a frequency of 3.5 GHz. The third plot 1106 corresponds to a radiation pattern for the WCCA 500 with the same physical dimensions at a frequency of 4.5 GHz. The fourth plot 1108 corresponds to a radiation pattern for the WCCA 500 with the same physical dimensions at a frequency of 5.5 GHz. The fifth plot 1110 corresponds to a radiation pattern for the WCCA 500 with the same physical dimensions at a frequency of 6.0 GHz.

It will be understood that various aspects or details of the disclosure may be changed without departing from the scope of the disclosure. It is not exhaustive and does not limit the claimed disclosures to the precise form disclosed. Furthermore, the foregoing description is for the purpose of illustration only, and not for the purpose of limitation. Modifications and variations are possible in light of the above description or may be acquired from practicing the disclosure. The claims and their equivalents define the scope of the disclosure. Moreover, although the techniques have been described in language specific to structural features and/or methodological acts, it is to be understood that the appended claims are not necessarily limited to the features or acts described. Rather, the features and acts are described as example implementations of such techniques.

Further, the disclosure comprises embodiments according to the following clauses.

Clause 1. A wide-band conformal coaxial antenna (WCCA) conformal to a surface, the WCCA comprising: an inner conductor extending towards the surface from a coaxial input below the surface, wherein the inner conductor has a first inner conductor diameter at the coaxial input and a second inner conductor diameter at a distal end of the inner conductor at or proximately below the surface, the inner conductor forms an inner conductor surface at the distal end of the inner conductor, and the second inner conductor diameter is larger than the first inner conductor diameter; an outer conductor surrounding the inner conductor extending from the coaxial input to the surface, wherein the outer conductor has a first outer conductor diameter at the coaxial input and a second outer conductor diameter at the surface, and the second outer conductor diameter is larger than the first outer conductor diameter; and a dielectric layer between the inner conductor and the outer conductor.

Clause 2. A wide-band conformal coaxial antenna (WCCA) conformal to a surface, the WCCA comprising: a coaxial input; an inner conductor extending from the coaxial input to a distal end, wherein the inner conductor has a first inner conductor diameter at the coaxial input and has a second inner conductor diameter at the distal end, wherein the second inner conductor diameter is larger than the first inner conductor diameter; an outer conductor surrounding the inner conductor and extending from the coaxial input to the surface, wherein the outer conductor has a first outer conductor diameter at the coaxial input and has a second outer conductor diameter at the surface, and wherein the second outer conductor diameter is larger than the first outer conductor diameter; and a dielectric layer between the inner conductor and the outer conductor.

Clause 3. The WCCA of the clauses 1 or 2, wherein the dielectric layer includes at least two dielectric materials.

Clause 4. The WCCA of the clauses 1, 2, or 3, wherein the dielectric layer extends from the coaxial input to the surface and includes a dielectric surface that is approximately flush with the surface.

Clause 5. The WCCA of clause 4, wherein the inner conductor surface is approximately flush with the dielectric surface.

Clause 6. The WCCA of clause 5, wherein the dielectric surface comprises a resistive element.

Clause 7. The WCCA of clause 6, wherein the resistive element comprises a plurality of spiral resistive elements.

Clause 8. The WCCA of any of the clauses 1, 2, 3, 4, 5, 6, or 7 wherein the combination of the surface, inner conductor surface, and dielectric surface forms an annular slot antenna.

Clause 9. The WCCA of any of the clauses 1, 2, 3, 4, 5, 6, 7, or 8, wherein the surface is electrically connected to the outer conductor and the surface is configured as a ground plane.

Clause 10. The WCCA of any of the clauses 1, 2, 3, 4, 5, 6, 7, 8, or 9, wherein the inner surface is below the dielectric surface.

Clause 11. The WCCA of the clauses 1 or 2, wherein the dielectric layer comprises a resistive element.

Clause 12. The WCCA of clause 11, wherein the resistive element comprises a plurality of spiral resistive elements.

Clause 13. The WCCA of any of the clauses 1, 2, 3, 4, 5, 6, 7, 8, 9, or 10, wherein the outer conductor is configured to taper between the first outer conductor diameter and the second outer conductor diameter.

Clause 14. The WCCA of clause 13, wherein the taper of the outer conductor is conical.

Clause 15. The WCCA of the clauses 13 or 14, wherein the inner conductor is configured to taper between the first inner conductor diameter and the second inner conductor diameter.

Clause 16. The WCCA of clause 15, wherein the taper of the inner conductor is conical.

Clause 17. The WCCA of clause 16, wherein the coaxial input is approximately two inches below the surface, the second inner conductor diameter is approximately two inches, and the second outer conductor diameter is approximately four inches.

Clause 18. The WCCA of clause 13, wherein the taper of the outer conductor is exponential.

Clause 19. The WCCA of clause 18, wherein: the inner conductor is configured to taper between the first inner conductor diameter and the second inner conductor diameter; and the taper of the inner conductor is exponential.

Clause 20. The WCCA of clause 19, wherein: the inner conductor comprises a bulb at the distal end of the inner conductor; the bulb is at or slightly below the surface; the inner conductor surface is a surface of the bulb; the second inner conductor diameter is a cross-sectional diameter of the bulb below the distal end of the inner conductor at a bulb cross-axis; the surface of the bulb begins at a first inner conductor section below the bulb and ends at the distal end of the inner conductor; and the surface of the bulb is configured to taper exponentially between the first inner conductor section and the bulb cross-axis.

Clause 21. The WCCA of clause 20, wherein the surface of the bulb is configured to taper exponentially from the bulb cross-axis to the distal end of the inner conductor.

Clause 22. A wide-band conformal coaxial antenna (WCCA) conformal to a surface, the WCCA comprising: an inner conductor extending towards the surface from a coaxial input below the surface; an outer conductor surrounding the inner conductor extending from the coaxial input to the surface; and a dielectric layer between the inner conductor and the outer conductor, wherein: the combination of the surface, inner conductor surface, and dielectric surface forms an annular slot antenna on the surface; the inner conductor has a first inner conductor diameter at the coaxial input and a second inner conductor diameter at a distal end of the inner conductor at or proximately below the surface; the outer conductor has a first outer conductor diameter at the coaxial input and a second outer conductor diameter at the surface; and the second inner conductor diameter is larger than the first inner conductor diameter and the second outer conductor diameter is larger than the first outer conductor diameter.

Clause 23. A wide-band conformal coaxial antenna (WCCA) conformal to a surface, the WCCA comprising: a coaxial input: an inner conductor extending from the coaxial input to an inner conductor surface at a distal end of the inner conductor; an outer conductor surrounding the inner conductor and extending from the coaxial input to the surface; and a dielectric layer between the inner conductor and the outer conductor, wherein: a combination of the surface, inner conductor surface, and dielectric surface forms an annular slot antenna on the surface, the inner conductor has a first inner conductor diameter at the coaxial input and a second inner conductor diameter at the distal end of the inner conductor, the outer conductor has a first outer conductor diameter at the coaxial input and a second outer conductor diameter at the surface, and the second inner conductor diameter is larger than the first inner conductor diameter and the second outer conductor diameter is larger than the first outer conductor diameter.

Clause 24. The WCCA of the clauses 22 or 23, wherein: the dielectric layer extends from the coaxial input to the surface and includes a dielectric surface that is approximately flush with the surface; and the inner conductor forms an inner conductor surface at the distal end of the inner conductor that is approximately flush with the dielectric surface.

Clause 25. The WCCA of the clauses 22, 23, or 24, wherein the surface is a conductor that is electrically connected to the outer conductor and the surface is configured as a ground plane.

Clause 26. The WCCA of clause 25, wherein: the outer conductor is configured to taper between the first outer conductor diameter and the second outer conductor diameter; the inner conductor is configured to taper between the first inner conductor diameter and the second inner conductor diameter; the outer conductor taper is conical; and the inner conductor taper is conical.

Clause 27. The WCCA of clause 25, wherein the taper of the outer conductor is exponential.

Clause 28. The WCCA of clause 27, wherein: the inner conductor is configured to taper between the first inner conductor diameter and the second inner conductor diameter; and the taper of the inner conductor is exponential.

Clause 29. The WCCA of clause 28, wherein: the inner conductor comprises a bulb at the distal end of the inner conductor, the bulb is at or slightly below the surface; the inner conductor surface is a surface area of the bulb; the second inner conductor diameter is a cross-sectional diameter of the bulb below the distal end of the inner conductor at a bulb cross-axis; the surface area of the bulb begins at a first inner conductor section below the bulb and ends at the distal end of the inner conductor; the surface area of the bulb is configured to taper exponentially between the first inner conductor section and the bulb cross-axis; and the surface area of the bulb surface is configured to taper exponentially from the bulb cross-axis to the distal end of the inner conductor.

Clause 30. A wide-band conformal coaxial antenna (WCCA) conformal to a surface, the WCCA comprising: a coaxial input: an inner conductor extending from the coaxial input to an inner conductor surface at a distal end of the inner conductor; an outer conductor surrounding the inner conductor and extending from the coaxial input to the surface; and a dielectric layer between the inner conductor and the outer conductor, wherein: the inner conductor has a first inner conductor diameter at the coaxial input and a second inner conductor diameter at the distal end of the inner conductor; the outer conductor has a first outer conductor diameter at the coaxial input and a second outer conductor diameter at the surface; the second inner conductor diameter is larger than the first inner conductor diameter and the second outer conductor diameter is larger than the first outer conductor diameter; the inner conductor comprises a bulb at the distal end of the inner conductor; the bulb is at or slightly below the surface; the inner conductor surface is a surface area of the bulb; the second inner conductor diameter is a cross-sectional diameter of the bulb below the distal end of the inner conductor at a bulb cross-axis; the surface area of the bulb begins at a first inner conductor section below the bulb and ends at the distal end of the inner conductor; the surface area of the bulb is configured to taper exponentially between the first inner conductor section and the bulb cross-axis; and the surface area of the bulb surface is configured to taper exponentially from the bulb cross-axis to the distal end of the inner conductor.

What is claimed is:

1. A wide-band conformal coaxial antenna (WCCA) conformal to a surface, the WCCA comprising:

a coaxial input;

an inner conductor extending from the coaxial input to a distal end of the inner conductor, wherein the inner conductor has a first inner conductor diameter at the coaxial input and has a second inner conductor diameter at the distal end, wherein the second inner conductor diameter is larger than the first inner conductor diameter;

an outer conductor surrounding the inner conductor and extending from the coaxial input to the surface, wherein the outer conductor has a first outer conductor diameter at the coaxial input and has a second outer conductor diameter at the surface, and wherein the second outer conductor diameter is larger than the first outer conductor diameter; and a dielectric material layer between the inner conductor and the outer conductor that extends from the coaxial input to the surface;

wherein the surface is electrically connected to the outer conductor, and wherein the surface is configured as a ground plane.

2. The WCCA of claim 1, wherein the dielectric material layer includes at least two dielectric materials.

3. The WCCA of claim 1, wherein the dielectric material layer extends from the coaxial input to the surface and includes a dielectric surface that is approximately flush with the surface.

4. The WCCA of claim 3, wherein an inner conductor surface at the distal end of the inner conductor is approximately flush with the dielectric surface.

5. The WCCA of claim 4, wherein the dielectric surface comprises a resistive element.

6. The WCCA of claim 5, wherein the resistive element comprises a plurality of spiral resistive elements.

7. The WCCA of claim 4, wherein a combination of the surface, the inner conductor surface, and dielectric surface is configured to form an annular slot antenna.

8. A wide-band conformal coaxial antenna (WCCA) conformal to a surface, the WCCA comprising:

a coaxial input;

an inner conductor extending from the coaxial input to an inner conductor surface at a distal end of the inner conductor;

an outer conductor surrounding the inner conductor and extending from the coaxial input to the surface; and a dielectric material layer between the inner conductor and the outer conductor that extends from the coaxial input to the surface;

wherein the surface is electrically connected to the outer conductor, and wherein the surface is configured as a ground plane; and wherein:

a combination of the surface, the inner conductor surface, and a dielectric surface for the dielectric material layer is configured to form an annular slot antenna on the surface;

the inner conductor has a first inner conductor diameter at the coaxial input and a second inner conductor diameter at the distal end of the inner conductor;

the outer conductor has a first outer conductor diameter at the coaxial input and a second outer conductor diameter at the surface; and the second inner conductor diameter is larger than the first inner conductor diameter and the second outer conductor diameter is larger than the first outer conductor diameter.

9. The WCCA of claim 3, wherein an inner conductor surface at the distal end of the inner conductor is below the dielectric surface.

10. The WCCA of claim 1, wherein the outer conductor is configured to taper between the first outer conductor diameter and the second outer conductor diameter.

11. The WCCA of claim 10, wherein:

the taper of the outer conductor is conical;

the inner conductor is configured to taper between the first inner conductor diameter and the second inner conductor diameter; and the taper of the inner conductor is conical.

12. The WCCA of claim 11, wherein the coaxial input is approximately two inches below the surface, the second inner conductor diameter is approximately two inches, and the second outer conductor diameter is approximately four inches.

13. The WCCA of claim 10, wherein:

the taper of the outer conductor is exponential;

the inner conductor is configured to taper between the first inner conductor diameter and the second inner conductor diameter; and the taper of the inner conductor is exponential.

14. The WCCA of claim 10, wherein:

the inner conductor comprises a bulb at the distal end of the inner conductor;

the bulb is at or slightly below the surface;

the second inner conductor diameter is a cross-sectional diameter of the bulb below the distal end of the inner conductor at a bulb cross-axis;

a surface of the bulb begins at a first inner conductor section below the bulb and ends at the distal end of the inner conductor; and the surface of the bulb is configured to taper exponentially between the first inner conductor section and the bulb cross-axis.

15. The WCCA of claim 14, wherein the surface of the bulb is configured to taper exponentially from the bulb cross-axis to the distal end of the inner conductor.

16. The WCCA of claim 8, wherein the surface is a conductor.

17. The WCCA of claim 8, wherein:

the dielectric material layer extends from the coaxial input to the surface and includes a dielectric surface that is approximately flush with the surface; and the inner conductor surface is approximately flush with the dielectric surface.

18. The WCCA of claim 17, wherein:

the outer conductor is configured to taper between the first outer conductor diameter and the second outer conductor diameter;

the inner conductor is configured to taper between the first inner conductor diameter and the second inner conductor diameter;

the taper of the outer conductor is conical; and the taper of the inner conductor is conical.

19. The WCCA of claim 17, wherein:

the outer conductor is configured to taper between the first outer conductor diameter and the second outer conductor diameter;

the inner conductor is configured to taper between the first inner conductor diameter and the second inner conductor diameter;

the taper of the outer conductor is exponential; and the taper of the inner conductor is exponential.

20. A wide-band conformal coaxial antenna (WCCA) conformal to a surface, the WCCA comprising:

a coaxial input;

an inner conductor extending from the coaxial input to a distal end of the inner conductor;

an outer conductor surrounding the inner conductor and extending from the coaxial input to the surface; and a dielectric layer between the inner conductor and the outer conductor;

wherein:

the inner conductor has a first inner conductor diameter at the coaxial input and a second inner conductor diameter at the distal end of the inner conductor;

the outer conductor has a first outer conductor diameter at the coaxial input and a second outer conductor diameter at the surface;

the second inner conductor diameter is larger than the first inner conductor diameter and the second outer conductor diameter is larger than the first outer conductor diameter;

the inner conductor comprises a bulb at the distal end of the inner conductor;

the bulb is at or slightly below the surface;

the second inner conductor diameter is a cross-sectional diameter of the bulb below the distal end of the inner conductor at a bulb cross-axis;

a surface area of the bulb begins at a first inner conductor section below the bulb and ends at the distal end of the inner conductor; and the surface area of the bulb is configured to taper exponentially between the first inner conductor section and the bulb cross-axis and to taper exponentially from the bulb cross-axis to the distal end of the inner conductor.

* * * * *